US008539804B2

(12) United States Patent
Jonsson

(10) Patent No.: US 8,539,804 B2
(45) Date of Patent: Sep. 24, 2013

(54) METHOD AND DEVICE FOR CONTROLLING A ROLL GAP

(75) Inventor: Lars Jonsson, Västerås (SE)

(73) Assignee: ABB AB, Västerås (SE)

( * ) Notice: Subject to any disclaimer, the term of this patent is extended or adjusted under 35 U.S.C. 154(b) by 1119 days.

(21) Appl. No.: 12/308,961

(22) PCT Filed: May 21, 2007

(86) PCT No.: PCT/SE2007/050337

§ 371 (c)(1),
(2), (4) Date: Dec. 30, 2008

(87) PCT Pub. No.: WO2008/002254

PCT Pub. Date: Jan. 3, 2008

(65) Prior Publication Data

US 2009/0277241 A1 Nov. 12, 2009

(30) Foreign Application Priority Data

Jun. 30, 2006 (SE) ..... 0601457

(51) Int. Cl.
*B21B 37/00* (2006.01)

(52) U.S. Cl.
USPC ..... 72/9.3; 72/11.7; 72/11.8; 72/160; 72/241.8; 700/152; 700/154

(58) Field of Classification Search
USPC ..... 72/9.3, 9.1, 9.2, 11.7, 11.8, 160, 72/241.8; 700/21, 23, 26, 148, 150, 154, 700/155, 156
See application file for complete search history.

(56) References Cited

U.S. PATENT DOCUMENTS

| | | | | |
|---|---|---|---|---|
| 6,098,060 | A | 8/2000 | Yuan et al. | |
| 7,293,440 | B2 * | 11/2007 | Horikawa et al. | 72/9.3 |

FOREIGN PATENT DOCUMENTS

| | | | |
|---|---|---|---|
| JP | 2129009 | | 3/1972 |
| JP | 62-089510 | | 4/1987 |
| JP | 62-130707 | | 6/1987 |
| JP | 5-146802 | | 6/1993 |
| JP | 6-87006 | | 3/1994 |
| JP | 6-099211 | | 4/1994 |
| JP | 10034214 | | 2/1998 |
| JP | 10043806 | | 2/1998 |
| WO | 2006/008808 | | 1/2006 |
| WO | WO2006/008808 | * | 1/2006 |

* cited by examiner

*Primary Examiner* — David B Jones
(74) *Attorney, Agent, or Firm* — Dilworth & Barrese, LLP.

(57) ABSTRACT

The invention relates to a method and a device for controlling a roll gap when rolling a strip (1) in a rolling mill including at least two rolls (3*a-b*,4*a-b*), and at least two roll gap actuators (6,7) that independently control the size of the roll gap. The device is adapted to receive information on the amount of wedge shape ($POSact_{OS}$,$POSact_{DS}$) in the strip thickness profile across the strip width, and to control said actuators, based on said information on the amount of wedge shape in the strip thickness profile, such that the relative reduction of the strip on both sides of the rolling mill become essentially the same.

23 Claims, 4 Drawing Sheets

METHOD AND DEVICE FOR CONTROLLING A ROLL GAP

FIELD OF THE INVENTION

The invention relates to the production of substantially long and flat strips or sheets. In the following strips and sheets are used synonymously. For example, the strip is made of a metal such as copper, steel or aluminum. More particularly, the invention relates to a method and a device for controlling a roll gap when rolling a strip in a rolling mill including at least two rolls and at least two actuators that independently control the size of the roll gap.

The present invention is useful for hot rolling as well as for cold rolling.

PRIOR ART

During production of a metal strip it is common practice to roll the material to a desired dimension in a rolling mill. The rolling mill includes at least, two rolls and a thickness control system that controls the gap between the rolls, also denoted the roll gap, and thereby the thickness of the produced strip. According to common terminology, one side of the rolling mill is denoted an operator side and the other side is denoted a drive side. Each of the operator side and the drive side is provided with actuators, for example a mechanical actuator such as hydraulic actuator, for adjusting the distance between the rolls. Thus, the roll gap on the operator side and the drive side can be adjusted independently of each other. It is also known to use thermal actuators for adjusting the roll gap. A thermal actuator adjusts the roll gap by cooling or heating parts of the working rolls. Besides the thickness control, the rolling mill is also provided with a flatness control.

For control of the thickness, the thickness of the strip is measured at, at least, one point on the strip after rolling, i.e. after the strip has passed through the work rolls. Usually, the thickness is measured at a point in the center of the strip. This measurement is used as input to the thickness control, together with a desired value of the thickness of the strip. Thus, thickness control according to the prior art aims at a constant reduction of the strip across the width of the strip.

Sometimes it happens that a strip material, before rolling, has an asymmetric thickness profile. For example, hot rolled strips often have a thickness profile that is thickest at the center of the strip and is decreasing towards the sides of the strip. In some cases, the thickness profile of the strip material is tapering towards one of its ends, which means that the strip material is thicker in one of its end than in the other end, also denoted a wedge shaped strip. Strips materials with tapered thickness profiles are, for example, common in narrow cold rolling mills where a wide hot-rolled strip, having a thickness profile that is thickest at the center of the strip, is divided into two narrower strips before cold milling.

As long as the thickness of the strip before rolling is essentially constant over the width of the strip, the thickness control system works fine. However, if the strip before rolling has an asymmetric thickness profile, the thickness control system will create an asymmetric flatness error in the strip. This flatness error is due to the fact that the thickness reduction of the strip causes a relative elongation of the strip of the same amount as the relative thickness reduction. If, for example, one side of the strip before rolling is thicker than the other side, the relative elongation of the strip after rolling becomes smaller on that side than on the other side, which leads to flatness problem. After some time, this flatness error can be detected and corrected by the flatness control system. However, during this time the flatness of the strip will not be optimal. This flatness error is created even if the roll gap is perfectly adjusted to the incoming thickness profile of the strip.

Different forms of setup models are today used in order to match the roll gap to the thickness profile of the strip. However, as soon as a thickness correction is done, mainly in the beginning and end of the strip, the thickness correction will create an asymmetric flatness error when rolling a wedge shape strip. This is due to the fact that, according to prior art, thickness corrections are always done with the same amount on both operator and drive side of the mill. Flatness error may lead to part or parts of the strip having to be rejected. Thus, flatness problem is costly for the strip producer.

OBJECTS AND SUMMARY OF THE INVENTION

The object of the present invention is to provide an attractive solution to the above problem.

According to one aspect of the invention this object is achieved with a method as defined herein. Such a method comprises receiving information on the amount of wedge shape in the strip thickness profile across the strip width, and based thereon controlling the actuators such that the relative reduction of the strip on both sides of the rolling mill becomes essentially the same.

The thickness control according to the invention is performed with regard to the fact that the workpiece before rolling may have different thickness profiles across its width. According to the invention, the thickness control is made with regard to the relative reduction of the strip, instead of with regard to the absolute reduction of the strip as in the prior art. A constant relative reduction across the width of the strip will cause a constant relative elongation across the width of the strip, and thus a flat strip. Thus, when rolling wedge shaped strips, i.e. strips that are thicker on one side compared to the other side, it is important that both sides have the same relative thickness reduction during rolling.

To be able to control the actuators so that the relative reduction on both sides of the rolling mill becomes essentially the same, it is necessary to have information on the amount of wedge shape in the strip thickness profile across the strip width. This information can be obtained in different ways. The information could be given directly from measurement of the strip thickness at least two points across the strip width, or indirectly via receiving the positions of the roll gap actuators on operator and drive side. This information is, for example, obtained from a preceding hot rolling process, or is measured, for example by means of scanning. During rolling it is normal to position the roll gap actuators to minimize the flatness error thus making the work rolls follow the thickness profile wedge of the strip. Therefore the positions of the actuators quite well reflect the wedge shape of the strip. It is also possible to estimate the wedge shape in the strip thickness profile. Alternatively, information on the thickness profile is determined based on a measured flatness error together with information of the roll gap actuators positions.

According to an embodiment of the invention, the rolling mill further includes a thickness control system, which calculates a thickness correction for the roll gap based on a desired strip thickness, and the method further comprises receiving information on the thickness correction to be done, and controlling the actuators, based on the thickness correction and the amount of wedge shape in the strip thickness, such that the relative thickness correction on both sides of the rolling mill becomes essentially the same. According to this embodiment, the control of the actuators, such that the relative reduction of the strip on both sides of the rolling mill becomes essentially the same, is achieved by controlling the actuators such that the relative thickness correction on both sides of the rolling mill becomes essentially the same.

The desired strip thickness and thereby the desired thickness reduction in the roll gap are commonly controlled with an automatic thickness control system (AGC). This system continuously calculates thickness corrections, which are fed to a roll gap actuator control system. The thickness control system comprises a thickness correction loop that repeatedly calculates the desired thickness correction for the roll gap based on a desired strip thickness and measurements of the actual strip thickness after rolling.

The method further includes receiving information from the thickness control system about the amount of thickness correction to be made. In order to achieve the same relative reduction on both sides of the mill, each correction output also has to give the same relative thickness correction on both sides of the mill. Applying the thickness correction symmetrically on both sides of the mill, as in the prior art, means to create a flatness error when rolling a wedge shaped strip. The relative reduction of the strip is equal to the sum of all relative thickness corrections made from the beginning of the rolling of the strip. If the roll gap is controlled such that the relative thickness correction on both sides of the rolling mill becomes essentially the same in each step of the thickness correction loop, a constant relative reduction across the width of the strip will be achieved. According to this embodiment of the invention, the thickness correction is distributed to the actuators on both sides of the mill so that the relative thickness corrections on both sides of the rolling mill become essentially the same, which results in the flatness error being minimized. An advantage with this embodiment is that it uses information on the thickness correction, which is already available from the thickness control system, in order to achieve the same total relative reduction on both sides of the mill.

The relative thickness correction is commonly defined as the quotient of the thickness correction from the thickness control system and the actual thickness of the strip, either before or after rolling.

According to another embodiment of the invention, the method comprises receiving information on the thickness of the strip before rolling the strip at least two points across the width of the strip, receiving information on the thickness of the strip after rolling the strip at least one point across the width of the strip, computing a relative reduction of the strip based on the thickness of the strip before and after rolling, and controlling the actuators based on the computed relative reduction of the strip and the information on the thickness of the strip before rolling the strip at least two points.

The relative reduction, also denoted the fractional reduction, of the strip is commonly defined as the difference between the incoming thickness of the strip, i.e. the thickness of the strip before rolling, and outgoing thickness of the strip, i.e. the thickness of the strip after rolling, divided by the incoming thickness of the strip: $(H-h)/H$, where H is the incoming thickness and h the outgoing thickness.

The relative reduction is determined at one point across the width of the strip, for example at the center of the strip or at one of its ends, and then the size of the roll gap, i.e. the distance between the rolls, is controlled in such way that the same relative reduction is achieved at least at another point across the width of the strip, and preferably across the whole width of the strip. The maximum number of control points across the width of the rolls depends on the number of actuators controlling the roll gap. For example, if the rolling mill has two actuators controlling the roll gap, it is possible to control the size of the roll gap at two points across the width of the rolls.

According to another embodiment of the invention, the roll gap actuators independently control the size of the roll gap on an operator side of the mill and on a drive side of the mill and the method comprises estimating a desired roll gap on the operator side of the mill based on the computed relative reduction of the strip and the thickness of the strip of the operator side before rolling and based thereon controlling the roll gap actuator on the operator side, and estimating a desired roll gap on the drive side of the mill based on the computed relative reduction of the strip and the thickness of the strip of the drive side before rolling and based thereon controlling the roll gap actuator on the drive side.

It is easy to realize that the method according to the invention, as defined in the appended set of method claims, is suitable for execution by a computer program having instructions corresponding to the steps in the inventive method when run on a processor unit.

According to a further aspect of the invention, the object is achieved by a computer program product directly loadable into the internal memory of a computer or a processor, comprising software code portions for performing the steps of the method according to the appended set of method claims, when the program is run on a computer. The computer program is provided either on a computer-readable medium or through a network.

According to another aspect of the invention, the object is achieved by a computer-readable medium having a program recorded thereon, when the program is to make a computer perform the steps of the method according to the appended set of method claims, and the program is run on the computer.

According to another aspect of the invention this object is achieved by a device as defined in claim 10. Such a device is adapted to receive information on the amount of wedge shape in the strip thickness profile across the strip width, and the device is adapted to control the actuators, based on the information on the amount of wedge shape in the strip thickness profile, such that the relative reduction of the strip on both sides of the rolling mill becomes essentially the same.

The invention is particularly useful for controlling strip thickness in a cold rolling mill. This is because of the common use of slit strip in cold rolling mills. During hot rolling it is normal to control the strip thickness profile to a symmetric shape.

The invention is particularly useful for controlling a roll gap when rolling a wedge shaped strip in a rolling mill.

BRIEF DESCRIPTION OF THE DRAWINGS

The invention will now be explained more closely by the description of different embodiments of the invention and with reference to the appended figures.

DETAILED DESCRIPTION OF PREFERRED EMBODIMENTS OF THE INVENTION

Figure 1:
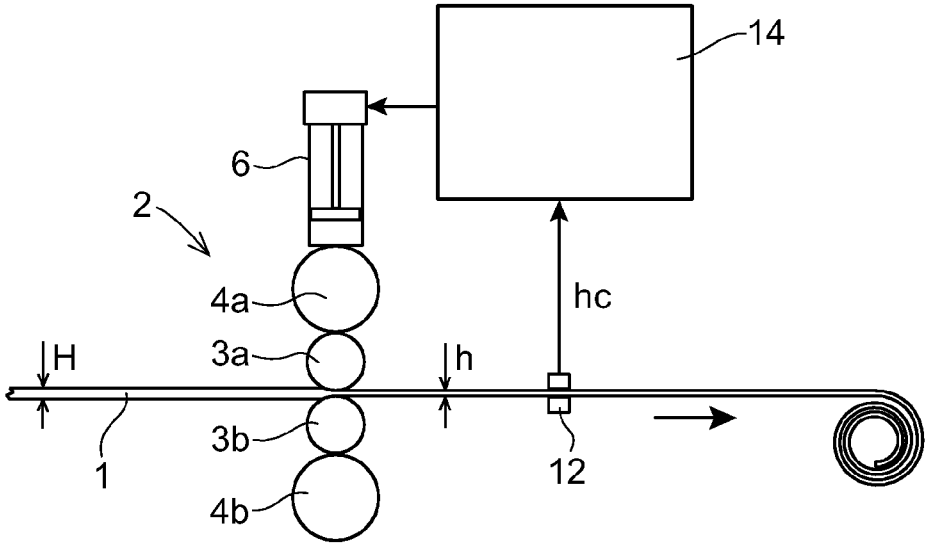
FIG. 1 shows schematically a side view of a rolling mill including a device for controlling the thickness of a strip according to a first embodiment of the invention.
Figure 2:
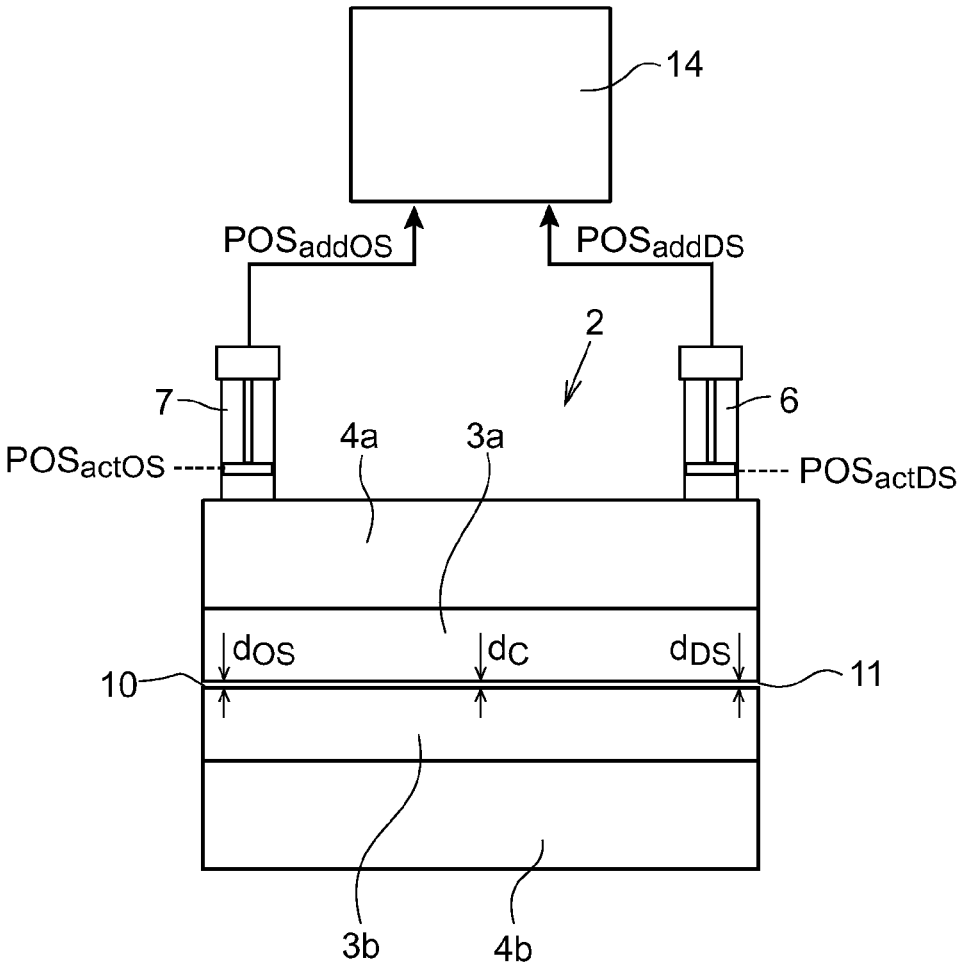
FIG. 2 shows a front view of the rolling mill shown in FIG. 1.
Figure 3:
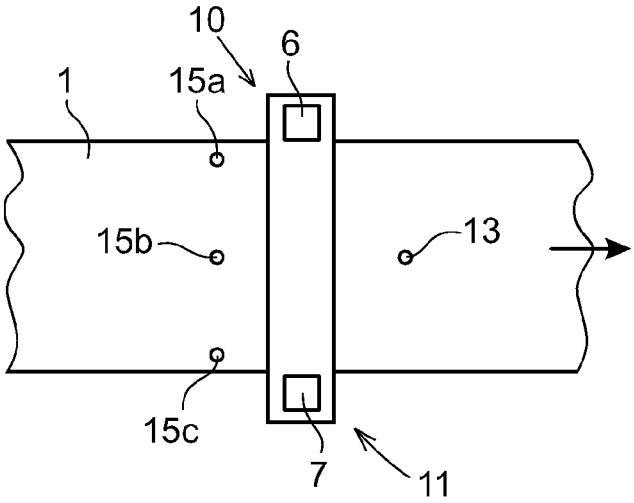
FIG. 3 shows a top view of the rolling mill shown in FIG. 1.

FIGS. 1-3 show a rolling mill, including a device 14 for controlling the roll gap of the mill according to a first embodiment of the invention, from different views. The figures show a metal strip 1 passing through a rolling mill 2 in a direction shown by an arrow. The rolling mill includes two main rolls 3*a-b* and two supporting rolls 4*a-b*. Two actuators 6,7, in this case hydraulic actuators, determine the distance between the main rolls 3*a-b*, also denoted the roll gap. The actuator 6 determines the distance between the rolls on a drive side 10 of the rolling mill and the actuator 7 determines the distance between the rolls on an operator side 11 of the rolling mill. The actuators 6, 7 independently control the size of the gap between the rolls on each side of the rolling mill. The rolling mill further includes a sensor 12 for measuring the thickness of the strip after the milling. The sensor 12 is located essentially at the center of the strip across the width of the strip, i.e. at essentially equal distance from both edges of the strip. The sensor 12 measures the thickness at one point 13 across the width of the strip. FIG. 2 shows the size $d_C$ of the roll gap in the centre of the mill, the size $d_{OS}$ of the roll gap on the operator side, and the size $d_{DS}$ of the roll gap on the drive side.

The device 14 is adapted to control the positions of the actuators 6,7. The device 14 receives information on the thickness H of the strip before rolling. In this embodiment, the thickness information is received from a preceding hot rolling process. Alternatively, the information may be received from a scanner scanning the strip before it enters into the rolling mill. In this embodiment, information on the thickness of the strip before milling is needed at three points 15*a-c* across the width of the strip, as shown in FIG. 3. The points should be selected at a distance from each other in a direction perpendicular to the direction of the movement of the strip. In this embodiment, the first point 15*a* is located at the operator side 10 of the rolling mill, the second point 15*b* is located at the center of the width of the strip, i.e. in a corresponding location as the sensor 12, and the third point 15*c* is located at the drive side 11 of the rolling mill.; and The device 14 is adapted to compute a relative reduction $$\frac{\Delta h}{H}$$

of the strip based on the thickness of the strip before and after rolling the strip, i.e. before and after reduction of the size of the strip. In this embodiment the relative reduction $$\frac{\Delta hc}{Hc}$$

of the center of the strip is calculated based on the strip thickness before reduction $H_C$, measured at point 15*b*, and the strip thickness after reduction $h_C$, measured at point 13 according to the following:

$$\Delta h_C = H_C - h_C \tag{1}$$

The device 14 is also adapted to compute a desired roll gap dos on the operator side of the mill based on the computed relative reduction of the center of strip $$\frac{\Delta hc}{Hc}$$

and the thickness $H_{OS}$ of the strip of the operator side before rolling, i.e. the thickness measured at point 15*a*. The computation unit is also adapted to compute a desired roll gap $d_{DS}$ on the drive side of the mill based on the computed relative reduction $$\frac{\Delta hc}{Hc}$$

of the center of the strip, and the thickness $H_{DS}$ of the strip of the drive side before rolling i.e. the measured thickness in point 15*c*.

Alternatively, it is also possible to calculate the relative reduction divided by the strip thickness after rolling $$\frac{\Delta hc}{hc},$$

this will achieve about the same result as dividing by the strip thickness after rolling.

The computation requires the use of some Arithmetic Logical Unit, ALU, but it can be implemented in either the digital circuitry of an FPGA, an ASIC, or a simple microprocessor. The device further comprises appropriate data processing means known in the art such as input and output means and memory means.

The device 14 is adapted to control the actuators 6,7 based on the computed desired roll gaps $d_{OS}$ and $d_{DS}$. The actuators adjust the distance between the rolls to the desired roll gaps on the operator and drive side. Thereby, the relative reduction across the width of the strip becomes essentially constant.

Figure 4:
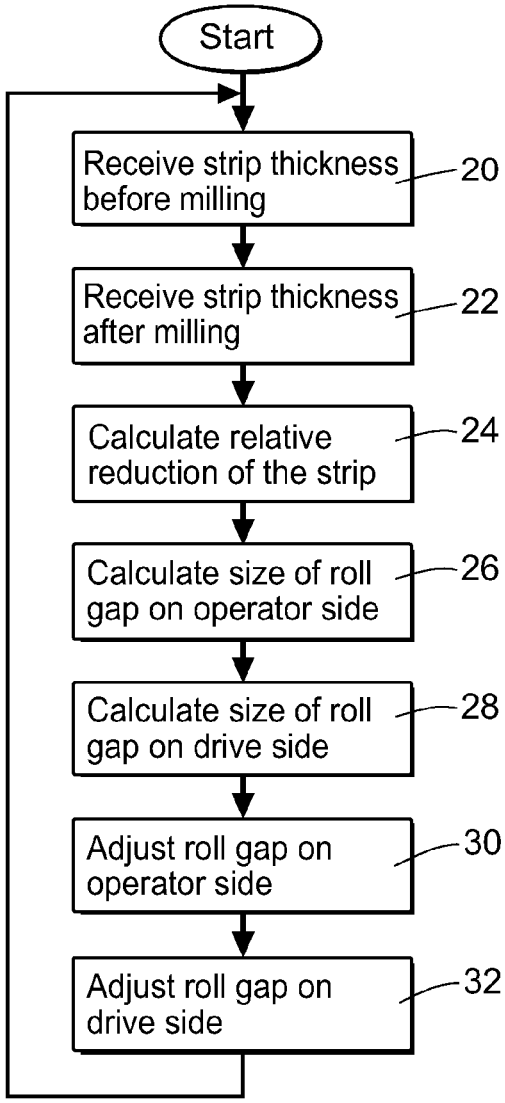
FIG. 4 shows a block diagram of a method for controlling the thickness of a strip in a rolling mill according to a first embodiment of the invention.

FIG. 4 is a flow chart illustration of the method and the computer program product according to a first embodiment of the present invention. It will be understood that each block of the flow chart can be implemented by computer program instructions.

Information on the strip thickness $H_C$, $H_{OS}$, $H_{DS}$ before rolling the strip is received, block 20. Information on the strip thickness $h_C$ after rolling the strip is received, block 22. The relative reduction of the center of the strip is computed, block 24, based on the thickness of the strip before and after rolling:

$$\frac{\Delta hc}{Hc} = (H_C - h_C)/H_C \tag{2}$$

In order to achieve a constant relative reduction of the strip across the width of the strip the following relation shall be valid:

$$\frac{\Delta hc}{Hc} = \frac{\Delta h_{OS}}{H_{OS}} = \frac{\Delta h_{DS}}{H_{DS}} \tag{3}$$

Thus, the relative reduction on the operator side $$\frac{\Delta h_{OS}}{H_{OS}}$$

and the drive side $$\frac{\Delta h_{DS}}{H_{DS}}$$

shall be the same as the relative reduction $$\frac{\Delta hc}{Hc}$$

in the centre of the strip.

The desired size $d_{OS}$ of the roll gap on the operator side is calculated based on the following equation, block 26:

$$d_{OS} = \frac{\Delta hc}{Hc} * H_{OS} \tag{4}$$

The desired size $d_{DS}$ of the roll gap on the drive side is calculated based on the following equation, block 28:

$$d_{DS} = \frac{\Delta hc}{Hc} * H_{DS} \tag{5}$$

Thereafter, the actuator 7 on the operator side is adjusted until the roll gap on the operator side is equal to the calculated size dos, block 30, and the actuator 6 on the drive side is adjusted until the roll gap on the drive side is equal to the calculated size $d_{DS}$, block 30.

Figure 5:
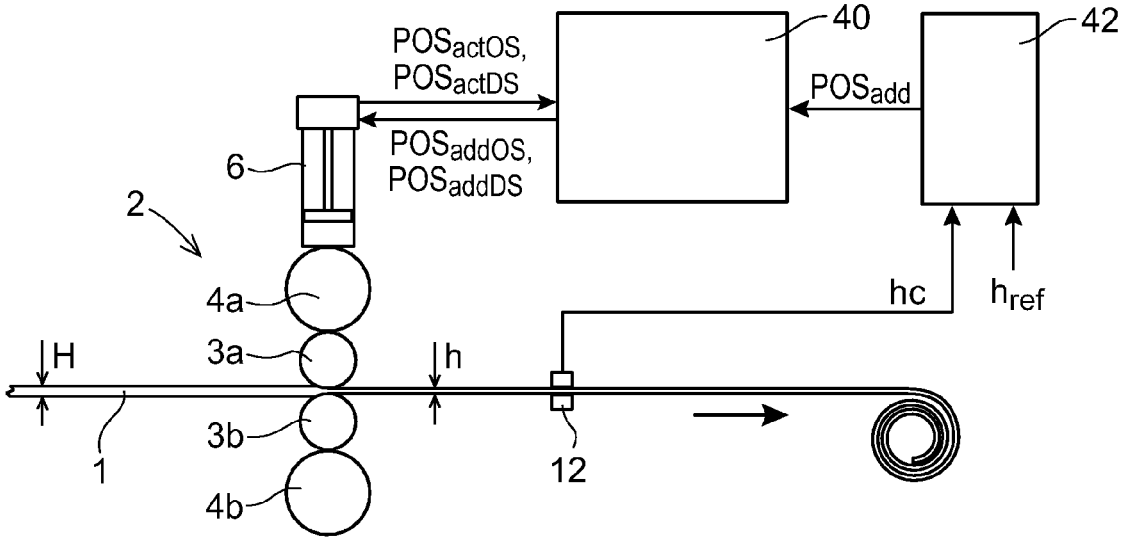
FIG. 5 shows schematically a side view of a rolling mill including a device for controlling the thickness of a strip according to a second embodiment of the invention.

FIG. 5 shows schematically a side view of a rolling mill including a device 40 for controlling the thickness of a strip according to a second embodiment of the invention. Components corresponding to those in FIG. 1 have been given the same reference numerals, and will not be described in more detail here. As can be seen in the drawing, the rolling mill further includes a thickness control system 42, which calculates a thickness correction $POS_{add}$ for the roll gap based on a desired strip thickness $h_{ref}$ and a measurement of the strip thickness $h_c$ after rolling. The thickness correction is calculated as the difference between the actual thickness of the strip after rolling and the desired strip thickness. The thickness correction is in the order of μm. The device 42 is adapted to receiving the thickness correction $POS_{add}$ from the thickness control system 42, and to generate control signals to the actuators 6,7, based on the thickness correction and the amount of wedge shape in the strip thickness, such that the relative thickness corrections on both sides of the rolling mill become essentially the same.

The thickness control system 42 continuously calculates thickness corrections $POS_{add}$, which are fed to the device 40. In order to achieve the same total relative reduction on both sides of the mill, each correction output also has to give the same relative correction on both sides of the mill. When rolling wedge shaped strips i.e. strips that are thicker on one side compared to the other side, it is important that both sides have the same relative thickness reduction during rolling.

The following equations are applied in order to ensure the same relative thickness reduction across the strip:

$$POS_{add}=(POS_{addOS}+POS_{addDS})/2 \tag{6}$$

Where, $POS_{add}$=thickness correction calculated from the thickness control system $POS_{addOS}$=thickness correction to be applied to the roll gap actuator on the operator side of the mill $POS_{addDS}$=thickness correction to be applied to the roll gap actuator on the drive side of the mill W=relative strip wedge profile is defined by:

$$W=(H_{DS}-H_{OS})/H_{OS}$$

or (when using an automatic flatness control system):

$$W=(POS_{actDS}-POS_{actOS})/POS_{actOS} \tag{7}$$

where, $H_{DS}$=incoming strip thickness on operator side $H_{OS}$=incoming strip thickness on drive side $POS_{actDS}$=actual position of roll gap actuator(s) on drive side $POS_{actOS}$=actual position of roll gap actuator(s) on operator side In order to get the same relative thickness correction on both operator side and drive side the following must apply:

$$POS_{addDS}=POS_{addOS}(1+W) \tag{8}$$

Solving these equations give:

$$POS_{addDS}=POS_{addOS}(1+W)=(2POS_{add}-POS_{addDS})*(1+W)$$

$$POS_{addDS}=(2POS_{add}*(1+W))/(2+W) \tag{9}$$

$$POS_{addOS}=2POS_{add}-POS_{addDS} \tag{10}$$

Figure 6:
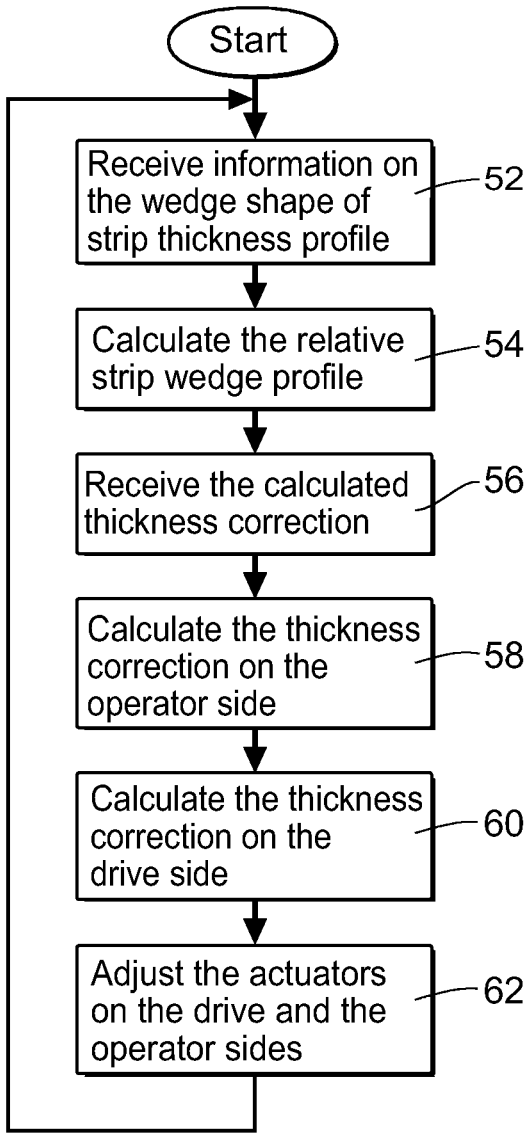
FIG. 6 shows a block diagram of a method for controlling the thickness of a strip in a rolling mill according to a second embodiment of the invention.

FIG. 6 is a flow chart illustration of the method and the computer program product according to a second embodiment of the present invention. It will be understood that each block of the flow chart can be implemented by computer program instructions.

Information on the amount of wedge shape in the strip thickness profile across the strip width is received, block 52. This information is, for example, the actual positions $POS_{actDS}$, $POS_{actOS}$ of roll gap actuators on the drive side and the operator side. The relative strip wedge profile W is calculated according to equation 7, block 54. The thickness correction $POS_{add}$ is received from the thickness control system, block 56. Thereafter, the thickness correction $POS_{addOS}$ to be applied to the roll gap actuator on the operator side of the mill is calculated according to equation 10, block 58, and the thickness correction $POS_{addDS}$ to be applied to the roll gap actuator on the drive side of the mill is calculated according to equation 9, block 60. Then, the actuators on the operator and drive sides are adjusted in accordance with the calculated thickness correction.

The term comprises/comprising when used in this specification is taken to specify the presence of stated features, integers, steps or components. However, the term does not preclude the presence or addition of one or more additional features, integers, steps or components or groups thereof.

The present invention is not limited to the embodiments disclosed but may be varied and modified within the scope of the following claims. For example, the relative strip wedge profile W can be calculated as $W=(POS_{actDS}-POS_{actOS})/POS_{actDS}$.

The invention claimed is:

1. A method for controlling a roll gap when rolling a strip (1) having lateral edges in a rolling mill including at least two rolls (3*a*-*b*,4*a*-*b*), and at least two roll gap actuators (6,7) positioned to be adjacent the respective lateral edges of the strip (1) and which independently control size of the roll gap, wherein the method comprises the steps of:

receiving information on amount of wedge shape (H, $POSact_{OS}$, $POSact_{DS}$) in strip thickness profile across strip width, determining relative reduction of the strip (1) by the formulas $\Delta h/H$ or $\Delta h/h$, where $\Delta h = H - h$, with H denoting thickness of the strip (1) before entering the roll pap and h denoting thickness of the strip after passing through the roll gap, and based thereon, controlling said actuators (6, 7) such that the relative reduction ($\Delta h$) of the strip (1) at both edges of the strip (1) is substantially identical.

2. The method according to claim 1, wherein said information on the amount of wedge shape includes information on thickness profile (H) across the strip width of the strip to be rolled.

3. The method according to claim 1, wherein said rolling mill further includes a thickness control system (42), which calculates a thickness correction (POSadd) for the roll gap based on a desired strip thickness ($h_{ref}$), and the method comprises:

receiving information on the thickness correction (POSadd) to be done, and controlling said actuators (6,7), based on the thickness correction and the amount of wedge shape in the strip thickness ($POSact_{OS}$, $POSact_{DS}$) such that relative thickness corrections at both edges of the strip (1) are substantially identical.

4. The method according to claim 3, wherein said roll gap actuators (6,7) independently control the size of the roll gap on an operator side of the mill adjacent one the lateral edges of the strip (1) and on a drive side of the mill adjacent the other later edge of the strip (1), and the method comprises computing a thickness correction ($POSadd_{OS}$) to be applied to the roll gap actuator on the operator side and a thickness correction ($POSadd_{DS}$) to be applied to the roll gap actuator on the operator side based on the thickness correction and the amount of wedge shape in the strip thickness.

5. The method according to claim 4, wherein desired size $d_{OS}$ of the roll gap on the operator side is calculated based on the following equation:

$$d_{OS} = \frac{\Delta hc}{Hc} * H_{OS},$$

where $H_{OS}$ is the strip thickness on the operator side before rolling, $H_c$ is the strip thickness at the center of the strip before rolling, and $\Delta h_c$ is the change in thickness at the center of the strip after rolling, and desired size $d_{DS}$ of the roll gap on the drive side is calculated based on the following equation:

$$d_{DS} = \frac{\Delta hc}{Hc} * H_{DS},$$

where $H_{DS}$ is the strip thickness on the drive side before rolling.

6. The method according to claim 4, wherein the thickness corrections are determined by the formula $$POS_{addOS} = 2POS_{add} - POS_{addDS}.$$

7. The method according to claim 1, wherein the method comprises:

receiving information on thickness of the strip before rolling the strip at least at two points (15*a*-*c*) across the width of the strip, receiving information on thickness of the strip after rolling the strip at least at one point (13) across the width of the strip, computing a relative reduction of the strip based on the thickness of the strip before and after rolling, and controlling said actuators (6,7) based on the computed relative reduction of the strip and said information on the thickness of the strip before rolling the strip at least at two points.

8. The method according to claim 7, wherein said roll gap actuators independently control the size of the roll gap on an operator side of the mill adjacent one of the lateral edges of the strip (1) and on a drive side of the mill adjacent the other lateral edge of the strip (1) and the method comprises estimating a desired roll gap on the operator side of the mill based on the computed relative reduction of the strip and thickness of the strip on of the operator side before rolling and based thereon controlling the roll gap actuator on the operator side, and estimating a desired roll gap on the drive side of the mill based on the computed relative reduction of the strip and the thickness of the strip on the drive side before rolling and based thereon controlling the roll gap actuator on the drive side.

9. A computer program product directly loadable into the internal memory of a computer, comprising software performing the steps of the method recited in claim 1.

10. A computer readable medium, having a program recorded thereon, where the program is to make a computer perform the steps of the method recited in claim 1, when said program is run on the computer.

11. The method according to claim 1, wherein thickness correction is on the order of microns.

12. A method for controlling a roll gap when rolling a strip (1) having lateral edges in a rolling mill and including at least two rolls (3*a*-*b*,4*a*-*b*), and at least two roll gap actuators (6,7) positioned to be adjacent the respective lateral edges of the strip (10) and which independently control size of the roll gap, wherein the method comprises:

receiving information on amount of wedge shape (H, $POSact_{OS}$, $POSact_{DS}$) in strip thickness profile across strip width, and based thereon, and controlling said actuators such that relative reduction of the strip at both edges of the strip (1) is substantially identical, and said information on the amount of wedge shape in the strip thickness profile includes actual positions ($POSact_{OS}$, $POSact_{DS}$) of said roll gap actuators.

13. A device for controlling a roll gap when rolling a strip (1) having lateral edges in a rolling mill having two sides and including at least two rolls (3*a*-*b*,4*a*-*b*), and at least two roll gap actuators (6,7) positioned to be adjacent the respective lateral edges of the strip (1) and which independently control size of the roll gap, wherein the device is adapted to receive information on amount of wedge shape (H, $POSact_{OS}$, $POSact_{DS}$) in strip thickness profile across strip width, determine relative reduction of the strip (1) by the formulas $\Delta h/H$ or $\Delta h/h$, where $\Delta h = H - h$, with H denoting thickness of the strip (1) before entering the roll gap and h denoting thickness of the strip after passing through the roll gap, and control said actuators (6,7), based on said information on the amount of wedge shape in the strip thickness profile, such that relative reduction (Ah) of the strip (1) at both edges of the strip (1) is substantially identical.

14. The device according to claim 13, wherein said information on the amount of wedge shape includes information on the thickness profile (H) across the strip width of the strip to be rolled.

15. The device according to claim 13, wherein said rolling mill further includes a thickness control system, which calculates a thickness correction for the roll gap based on a desired strip thickness, and the device is adapted to receive information on the thickness correction, and control said actuators, based on the thickness correction and the amount of wedge shape in the strip thickness, such that the relative thickness corrections at both edges of the strip (1) are substantially identical.

16. The device according to claim 15, wherein said roll gap actuators independently control the size of the roll gap on an operator side of the mill adjacent one of the lateral edges of the strip (1) and on a drive side of the mill adjacent the other lateral edge of the strip (1), and the device is adapted to compute a thickness correction to be applied to the roll gap actuator on the operator side and a thickness correction to be applied to the roll gap actuator on the drive side based on the thickness correction and the amount of wedge shape in the strip thickness.

17. The device according to claim 16, wherein desired size $d_{OS}$ of the roll gap on the operator side is calculated based on the following equation:

$$d_{OS} = \frac{\Delta hc}{Hc} * H_{OS},$$

where $H_{OS}$ is the strip thickness on the operator side before rolling, $H_c$ is the strip thickness at the center of the strip before rolling, and $\Delta h_c$ is the change in thickness at the center of the strip after rolling, and desired size $d_{DS}$ of the roll gap on the drive side is calculated based on the following equation:

$$d_{DS} = \frac{\Delta hc}{Hc} * H_{DS},$$

where $H_{DS}$ is the strip thickness on the drive side before rolling.

18. The device according to claim 16, wherein the thickness corrections are determined by the formula $$POS_{addOS} = 2POS_{add} - POS_{addDS}.$$

19. The device according to claim 13, wherein the device is adapted to receive information on the thickness of the strip before rolling the strip at least at two points across the width of the strip and after rolling the strip at least at one point across the width of the strip, compute a relative reduction of the strip based on the thickness of the strip before and after rolling, and control said actuators based on the computed relative reduction of the strip and said information on the thickness of the strip before rolling the strip at least at two points.

20. The device according to claim 19, wherein said roll gap actuators independently control the size of the roll gap on an operator side of the mill adjacent of the lateral edges of the strip (1) and on a drive side of the mill adjacent the other later edge of the strip (1), and the device is adapted to estimate a desired roll gap on the operator side of the mill based on the computed relative reduction of the strip and the thickness of the strip on the operator side before rolling and based thereon controlling the roll gap actuator on the operator side, and estimating a desired roll gap on the drive side of the mill based on the computed relative reduction of the strip and the thickness of the strip on the drive side before rolling and based thereon controlling the actuator on the drive side.

21. The device according to claim 13, wherein thickness correction is on the order of microns.

22. A device for controlling a roll gap when rolling a strip (1) having two sides in a rolling mill and including at least two rolls (3*a*-*b*,4*a*-*b*), and at least two roll gap actuators (6,7) positioned to be adjacent the respective lateral edges of the strip (1) and which independently control size of the roll gap, wherein the device is adapted to receive information on amount of wedge shape (H, $POSact_{OS}$, $POSact_{DS}$) in strip, thickness profile across strip width, and control said actuators, based on said information on the amount of wedge shape in the strip thickness profile, such that relative reduction of the strip (1) at both edges of the strip (1) is substantially identical, and said information on the amount of wedge shape includes actual positions ($POSact_{OS}$, $POSact_{DS}$) of said roll gap actuators.

23. A device for controlling a roll gap when rolling a strip (1) having lateral edges in a rolling mill, comprising two main rolls (3*a*, 3*b*) positioned to apply pressure to the strip (1), and two support rolls (4*a*, 4*b*) each positioned against a respective one of said main rolls (3*a*, 3*b*) on a side of the respective main roll (3*a*, 3*b*) opposite the strip (1), at least two roll gap actuators (6,7) arranged to contact one (4*a*) of said two support rolls (4*a*, 4*b*) adjacent the respective lateral edges of the strip (1) and independently control size of the roll gap, wherein the device is adapted to receive information on amount of wedge shape (H, $POSact_{OS}$, $POSact_{DS}$) in strip thickness profile across strip width, and control said actuators (6, 7), based on said information on the amount of wedge shape in the strip thickness profile, such that relative reduction of the strip at both edges of the strip (1) is substantially identical.

* * * * *